US008556677B2

(12) United States Patent
Allen

(10) Patent No.: US 8,556,677 B2
(45) **Date of Patent: *Oct. 15, 2013**

(54) FLEXING BRASSIERE

(75) Inventor: Donald Allen, Wantage, NJ (US)

(73) Assignee: Warnaco U.S., Inc., Milford, CT (US)

( * ) Notice: Subject to any disclaimer, the term of this patent is extended or adjusted under 35 U.S.C. 154(b) by 102 days.

This patent is subject to a terminal disclaimer.

(21) Appl. No.: 13/097,518

(22) Filed: Apr. 29, 2011

(65) Prior Publication Data

US 2011/0312245 A1 Dec. 22, 2011

Related U.S. Application Data

(63) Continuation-in-part of application No. 12/328,008, filed on Dec. 4, 2008, now Pat. No. 8,038,506.

(51) Int. Cl.
*A41C 3/00* (2006.01)

(52) U.S. Cl.
USPC ..... 450/66; 450/65; 450/39

(58) Field of Classification Search
USPC ..... 450/65, 66, 74–76, 39, 58, 59, 92, 93, 450/1; 2/243.1, 1, 69, 275; 66/171, 176, 66/177, 172 A, 175, 196, 197
See application file for complete search history.

(56) References Cited

U.S. PATENT DOCUMENTS

| | | | | |
|---|---|---|---|---|
| 2,185,159 | A | 12/1939 | Rubinstein | |
| 2,458,696 | A | 1/1949 | Elias | |
| 2,506,172 | A | 5/1950 | Plehn | |
| 2,612,642 | A | 10/1952 | Robins | |
| 3,665,929 | A | 5/1972 | Brantly | |
| 3,717,154 | A | 2/1973 | Spetalnik | |
| 6,059,633 | A | 5/2000 | Currier | |
| 6,645,040 | B2 * | 11/2003 | Rabinowicz et al. | 450/1 |
| 6,860,789 | B2 * | 3/2005 | Bell et al. | 450/20 |
| 7,144,294 | B2 * | 12/2006 | Bell et al. | 450/20 |
| 7,407,427 | B2 * | 8/2008 | Liu | 450/39 |
| 7,549,971 | B2 * | 6/2009 | Bell et al. | 602/75 |
| 7,682,219 | B2 * | 3/2010 | Falla | 450/92 |
| 2006/0105672 | A1 | 5/2006 | Donnelly | |
| 2006/0105673 | A1 | 5/2006 | Lau | |
| 2006/0105674 | A1 * | 5/2006 | Lau | 450/39 |
| 2006/0281389 | A1 * | 12/2006 | Liu | 450/1 |

(Continued)

OTHER PUBLICATIONS

United States Office Action dated Apr. 14, 2011, from corresponding U.S. Appl. No. 12/328,008.

*Primary Examiner* — Gloria Hale
(74) *Attorney, Agent, or Firm* — Katten Muchin Rosenman LLP

(57) ABSTRACT

A brassiere having flexibility, durability, and improved comfort for the wearer is provided. The side panel of the brassiere comprises a folded fabric and two elastic bands. The folded fabric has two opposing longitudinal edges, a top edge, and a bottom edge. Each of the two elastic bands is positioned in the interior of the folded fabric along a respective longitudinal edge, which also includes notches for orienting the bands. The folded fabric is sewn together at each of the top and bottom edges such that the two elastic bands are held in place. One of the longitudinal edges may be formed by sewing the folded fabric together to form a seam using a pull-out stitch. Each of the two elastic bands may include either of a woven elastic band or a knitted elastic band. The present invention further relates to a brassiere in which the side panels can flex independently of each other in conformance to the wearer's movements.

12 Claims, 17 Drawing Sheets

(56) References Cited

U.S. PATENT DOCUMENTS

2008/0153388 A1 6/2008 Liu
2008/0280529 A1* 11/2008 Simpson ..... 450/30
2008/0280530 A1* 11/2008 Simpson ..... 450/39
2008/0280533 A1* 11/2008 Simpson ..... 450/39
2008/0280535 A1* 11/2008 Simpson ..... 450/70
2009/0061732 A1* 3/2009 Simpson ..... 450/41

* cited by examiner

FLEXING BRASSIERE

CROSS-REFERENCE TO RELATED APPLICATIONS

This application is a continuation-in-part of and claims priority to U.S. Ser. No. 12/328,008 filed Dec. 4, 2008, which is pending and which is hereby incorporated in its entirety for all purposes.

BACKGROUND OF THE INVENTION

1. Field of the Invention

The present invention relates generally to a brassiere ("bra"). More particularly, the present invention relates to a brassiere that is especially designed to counteract aspects that typically cause physical discomfort to the wearer. The present invention further relates to a brassiere in which the side panels can flex independently of each other in conformance to the wearer's movements.

2. Description of the Related Art

A feature of conventional bras that is common for the wearer to experience discomfort in relation to the side panel construction. An elastic band has traditionally been added to the side panels, also known as the wings or wing portions, of a bra in order to enhance the elasticity of the side panel. This may assist in providing improved sizing characteristics of the bra and provide some degree of flexibility in the side panel size. For example, a wearer need not adjust the size of the chest band if the wearer increases or decreases in chest or bust size as the size change can, to a certain extent, be compensated for by the elastic band.

An elastic band may be sewn onto and along the length of the external side of the fabric layer facing/touching the wearer's skin when the bra is worn. The elastic band may be wrapped or covered by a fabric layer to form an assembly before being sewn onto the side panel.

The main disadvantage of this type of side panel construction is that the elastic band or the assembly may cause discomfort to the wearer and create a visually unappealing appearance.

This may increase localized friction on the skin of the wearer. The side panel may also dig into the wearer. Other parts of the side panel that do not include the elastic band may hence bulge out.

In some bras, designated elastic bands are not added to the side panels. The elasticity of the chest bands in such case is provided only by the natural elasticity of the fabric layers of the side panels or in combination with the natural elasticity of any foam layers added to the side panels. The main disadvantage of this type of construction is that the elasticity of the side panels may deteriorate after repeated washing of the bra or repeated or prolonged stretching of the side panels. This may be as a result of the properties of the materials used for making the fabric layers and any foam layers of the side panels.

It is therefore an object of the present invention to provide a brassiere that has improved side panel construction and/or a side panel for association with components to define a brassiere with improved side panel construction.

It is a further object of the present invention to provide an improved brassiere construction such that the side panels can flex and stretch independently of each other, conforming to the wearer's movements.

SUMMARY OF THE INVENTION

In one aspect, the invention provides a brassiere ("bra"). The bra has a pair of breast cups, a left side panel, a right side panel, and a closure. Each of the left and right side panels has a top longitudinal edge, a bottom longitudinal edge, a front-side edge and a back-side edge. The front-side edge of the left side panel is sewn together with a left portion of the pair of breast cups. The front-side edge of the right side panel is sewn together with a right portion of the pair of breast cups. The closure is sewn together with each of the respective back-side edges of the left and right side panels. The right side panel is formed using a single fabric by: folding the fabric such that two edges of the fabric meet along one of the longitudinal edges; sewing the two edges together to form a seam such that the fabric comprises in a tubular shape; reversing the fabric so that the first face is facing outward; flattening the fabric so that the seam substantially coincides with a first longitudinal edge; inserting a pattern into the fabric; cutting the fabric according to the inserted pattern; inserting a first elastic band into the fabric along the first longitudinal edge; inserting a second elastic band into the fabric along a second longitudinal edge; sewing together a top edge of the fabric such that a first respective portion of each of the first and second elastic bands is held in place; and sewing together a bottom edge of the fabric such that a second respective portion of each of the first and second elastic bands is held in place.

Preferably, the left side panel may be formed using a second fabric by: folding the second fabric such that two edges of the second fabric meet along one of the longitudinal edges; sewing the two edges together to form a seam such that the fabric comprises in a tubular shape; reversing the second fabric so that the first face is facing outward; flattening the second fabric so that the seam substantially coincides with a first longitudinal edge; inserting a pattern into the second fabric; cutting the second fabric according to the inserted pattern; inserting a third elastic band into the second fabric along the first longitudinal edge; inserting a fourth elastic band into the second fabric along a second longitudinal edge; sewing together a top edge of the second fabric such that a first respective portion of each of the third and fourth elastic bands is held in place; and sewing together a bottom edge of the second fabric such that a second respective portion of each of the third and fourth elastic bands is held in place.

Sewing the two edges together to form a seam may further include using a pull-out stitch. The pattern may include a plurality of notches. Inserting the first elastic band may further include orienting the first elastic band based on respective positions of the plurality of notches. Inserting the second elastic band may further include orienting the second elastic band based on respective positions of the plurality of notches.

Sewing together a top edge of the fabric may further include using a single needle stitch. Sewing together a bottom edge of the fabric may further include using a single needle stitch. Each of the first and second elastic bands may include either of a woven elastic band or a knitted elastic band.

In another aspect, the invention provides a side panel for a brassiere. The side panel comprises a folded fabric and two elastic bands. The folded fabric has two opposing longitudinal edges, a top edge, and a bottom edge. Each of the two elastic bands is positioned in the interior of the folded fabric along a respective longitudinal edge. The folded fabric is sewn together at each of the top and bottom edges such that the two elastic bands are held in place. One of the longitudinal edges may be formed by sewing the folded fabric together to form a seam using a pull-out stitch.

The side panel may further include a plurality of notches. Each of the two elastic bands may be oriented based on respective positions of the plurality of notches. The folded fabric may be sewn together at each of the top and bottom edges using a single needle stitch. Each of the two elastic bands may include either of a woven elastic band or a knitted elastic band.

In yet another aspect, the invention provides a method for constructing a brassiere ("bra"). The bra has two breast cups, a left side panel, a right side panel, and a closure. Each of the left and right side panels comprises a fabric having a first face and a second face. The method comprises the steps of: constructing the right side panel; constructing the left side panel; and sewing together the breast cups, the right side panel, the left side panel, and the closure to form the bra. The step of constructing the right side panel comprises the steps of: folding the fabric so that the second face is facing outward and that two edges of the fabric meet; sewing the two edges together to form a seam such that the fabric comprises in a tubular shape; reversing the fabric so that the first face is facing outward; flattening the fabric so that the seam substantially coincides with a first longitudinal edge; inserting a pattern into the fabric; cutting the fabric according to the inserted pattern; inserting a first elastic band into the fabric along the first longitudinal edge; inserting a second elastic band into the fabric along a second longitudinal edge; sewing together a top edge of the fabric such that a first respective portion of each of the first and second elastic bands is held in place; and sewing together a bottom edge of the fabric such that a second respective portion of each of the first and second elastic bands is held in place.

Preferably, the step of constructing the left side panel may comprise the steps of: folding a second fabric so that the second face is facing outward and that two edges of the second fabric meet; sewing the two edges together to form a seam such that the second fabric comprises in a tubular shape; reversing the second fabric so that the first face is facing outward; flattening the second fabric so that the seam substantially coincides with a first longitudinal edge; inserting a pattern into the second fabric; cutting the second fabric according to the inserted pattern; inserting a third elastic band into the second fabric along the first longitudinal edge; inserting a fourth elastic band into the second fabric along a second longitudinal edge; sewing together a top edge of the second fabric such that a first respective portion of each of the third and fourth elastic bands is held in place; and sewing together a bottom edge of the second fabric such that a second respective portion of each of the third and fourth elastic bands is held in place.

The step of sewing the two edges together to form a seam may further include using a pull-out stitch. The pattern may include a plurality of notches. The step of inserting the first elastic band may further include orienting the first elastic band based on respective positions of the plurality of notches. The step of inserting the second elastic band may further include orienting the second elastic band based on respective positions of the plurality of notches.

The step of sewing together a top edge of the fabric may further include using a single needle stitch. The step of sewing together a bottom edge of the fabric may further include using a single needle stitch. Each of the first and second elastic bands may include either of a woven elastic band or a knitted elastic band.

In yet a further aspect of the invention, a brassiere is provided in which the side panels can flex independently of each other in conformance to the wearer's movements.

Each left and right brassiere cup is flanked, respectively, by a left or right side panel. Each side panel is formed of a mirror-image piece of material, folded to form a top longitudinal edge where its longitudinal ends meet, and a bottom longitudinal edge along the fold in the material. A top edge of the side panel is cut to be joinable to a brassiere cup and a lower portion of a front connecting portion, positioned between and underneath the two brassiere cups. A bottom edge of the side panel is joinable to fastening means. A free-floating stretch-elastic band extends continuously through one side panel along the bottom longitudinal edge, through a bottom edge of the front connecting portion, into which the stretch-elastic band is stitched, and again free-floating along the bottom longitudinal edge of the other side panel. Each of a pair of fixed stretch-elastic band extends along the top longitudinal edge of each side panel, from the top edge to the bottom edge of the side panel. Each fixed stretch-elastic band is sewn into its respective side panel, i.e. is not free-floating. This resulting construction leaves each side panel to stretch independently of the other, allowing comfort and freedom of movement to the wearer. The stitched portion of the free-floating stretch-elastic band that lies along the lower edge of the front connecting portion also permits some stretch, though generally less stretch than in the side panels, with their free-floating stretch-elastic domains.

In another, yet further, aspect of the present invention, methods are provided for making a brassiere with independently flexing side panels. Two side-panel-cut pieces of material are folded longitudinally to form each side panel, each having a top longitudinal edge formed by the sewn longitudinal ends of the side-panel material, and a bottom longitudinal edge formed by the fold in the material, as well as a top edge and a bottom edge. A front-connecting-portion piece of material is folded to form an upper edge formed by the sewn ends of the front-connecting-portion material, and a lower edge formed by the fold in the material. The top edge of each side panel is sewn onto the left or right edge of the lower portion of the front connecting piece. A free-floating stretch-elastic band is positioned continuously along the bottom longitudinal edge of the side panels and the lower edge of the front connecting portion. The portion of the free-floating stretch-elastic band that lies along the lower edge of the front connecting portion is sewn in place, resulting in reduced elasticity in that portion of the free-floating band. The ends of the free-floating elastic band are sewn into bottom edge of each side panel. Each of a pair of fixed stretch-elastic band is sewn into its respective side panel along the top longitudinal edge of the side panel. A third elastic band is sewn into the upper edge of the front connecting portion. A pair of cups is sewn into place on either side of the front connecting piece and the top edge of each side panel. One half of a fastener mechanism is sewn to the bottom edge of each side panel. Shoulder straps are then attached.

DETAILED DESCRIPTION OF THE INVENTION

Figure 1:
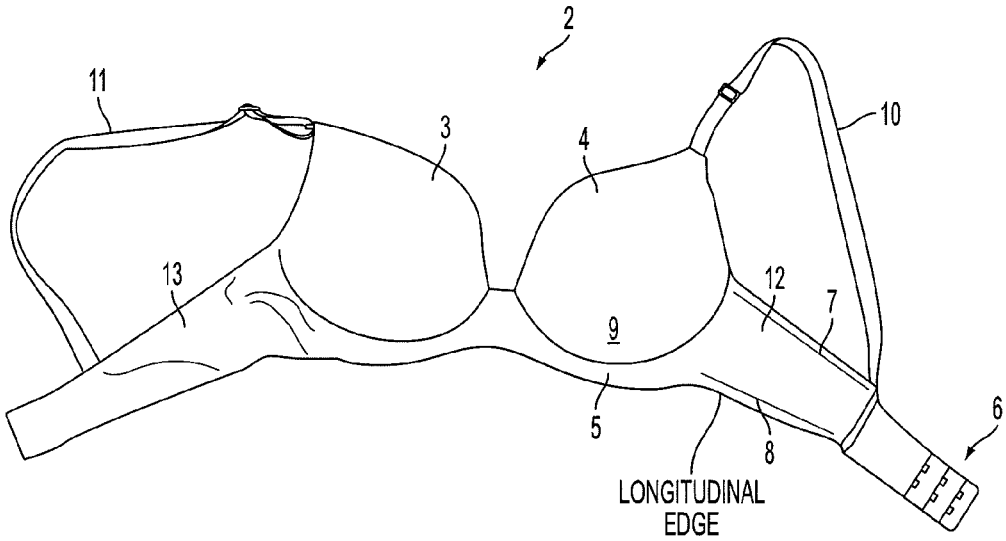
FIG. 1 illustrates a brassiere according to a preferred embodiment of the invention.

Referring to FIG. 1, in accordance with a preferred embodiment of the present invention, there is shown a bra 2 that may generally be defined by breast cups 3 and 4, shoulder straps 10 and 11, side panels 12 and 13, and closure 6. Side panel 12 includes elastic bands 7 and 8 along respective longitudinal edges, including longitudinal edge 5.

Closure 6 may be disposed as illustrated herein in the back as a back connecting portion or as a front-closure as well known in the art. Thus, bra 2 may be a back-closing bra or a front closing bra.

Such over the shoulder straps may however be optional as it is envisaged that the bra may also be of a strapless version. Indeed, while reference is herein made to a bra, it is envisaged that the assembly of panels component parts and items to define such, may alternatively be incorporated into other garments such as, for example, evening dresses or bathing suits or similar.

At the ends of each of the closures 6 may be fasteners that are mutually cooperative to allow for the bra to be fastened about the chest of a wearer.

The bra may be seamless and made from materials at least some of which are molded or moldable and that are engaged to each other preferably at least in part by lamination.

As can be seen with reference to FIG. 1, the breast cups 3, 4 may be secured to the side panels 12, 13 and the shoulder straps 10, 11. In addition or in the alternative to should straps 10, 11 that are secured to bra 2, an attachment means comprising a hook (not shown) and a catch 10*a* that is secured to side panel 12, e.g., side panel 13, via a fabric reinforcement 10*b* as shown for example, in FIG. 3*e*.

Such securing of the breast cup may occur by adhesive and/or ultrasonic welding or other forms of welding and/or by stitching.

Bra 2 may be any kind of bra, one having underwires, no wires, having a longitudinal edge under the cups or not.

An object of the present invention is to provide a side panel for a bra that enables the wearer to feel more comfortable wearing the bra as compared with conventional bras. Accordingly, with reference to FIGS. 2, 3*a*-3*d*, and 4, a side panel 12 of a bra comprises minimal stitching.

Figure 3A:
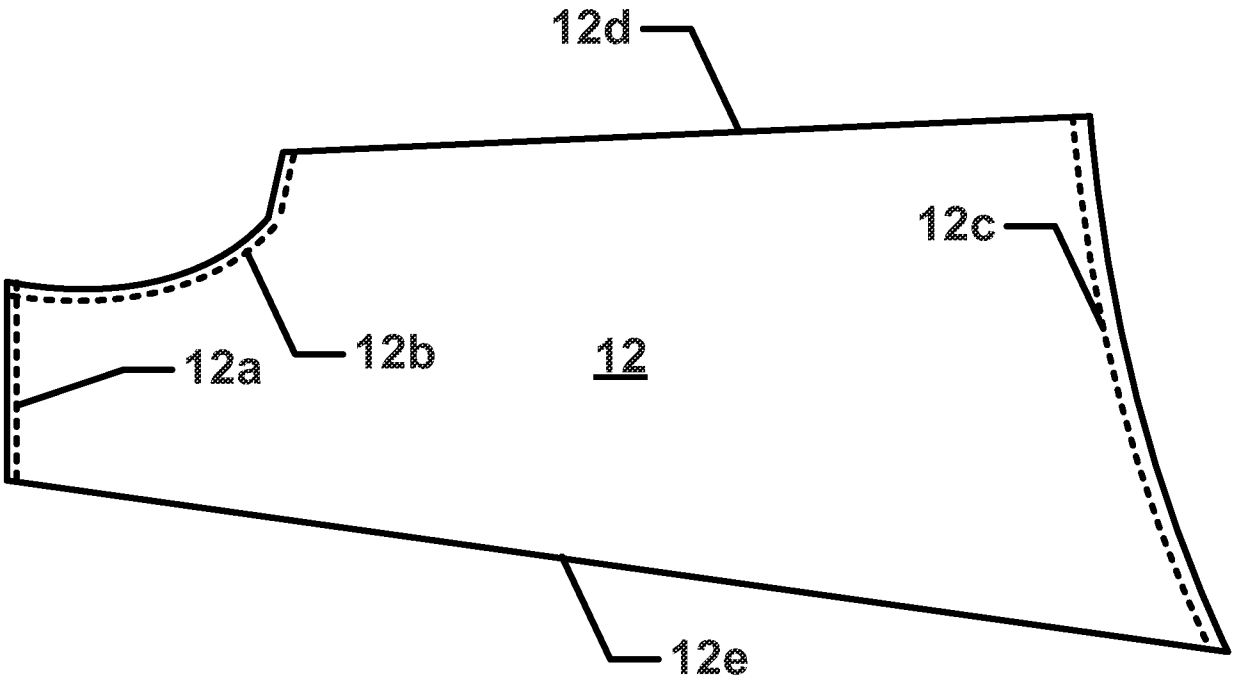
FIG. 3*a* is a schematic view of an obverse side of a side panel of a brassiere according to a preferred embodiment of the invention.
Figure 3B:
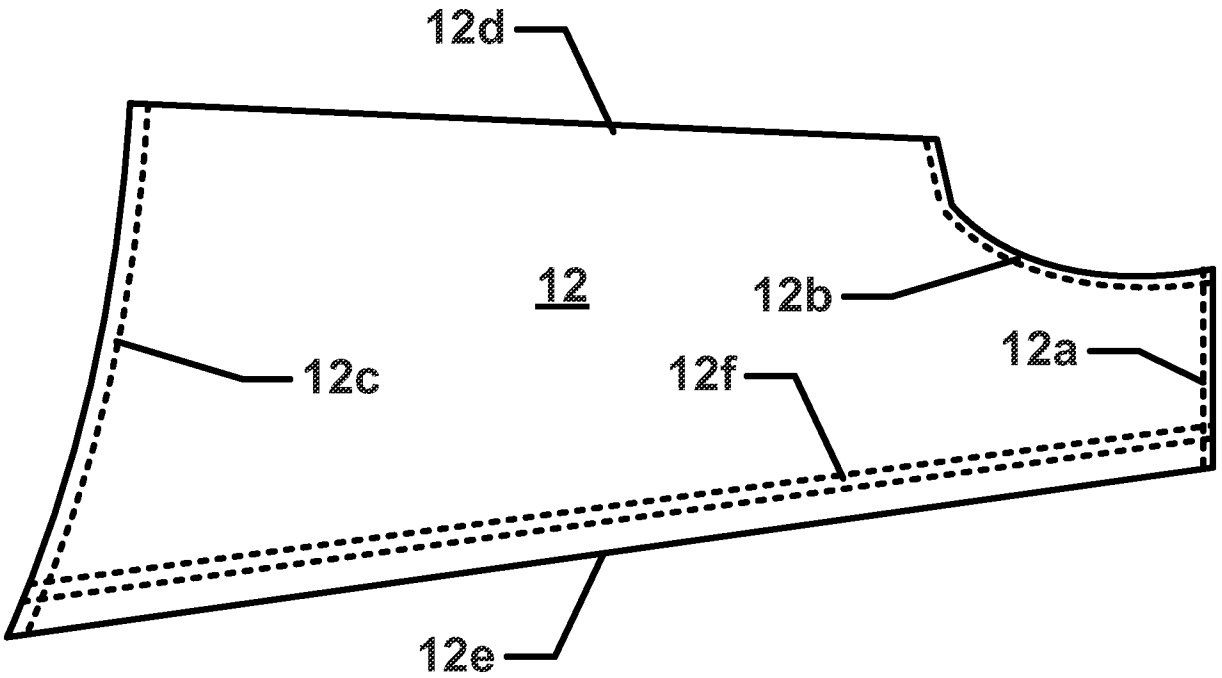
FIG. 3*b* is a schematic of a reverse side of the side panel of FIG. 3*a*.
Figure 3C:
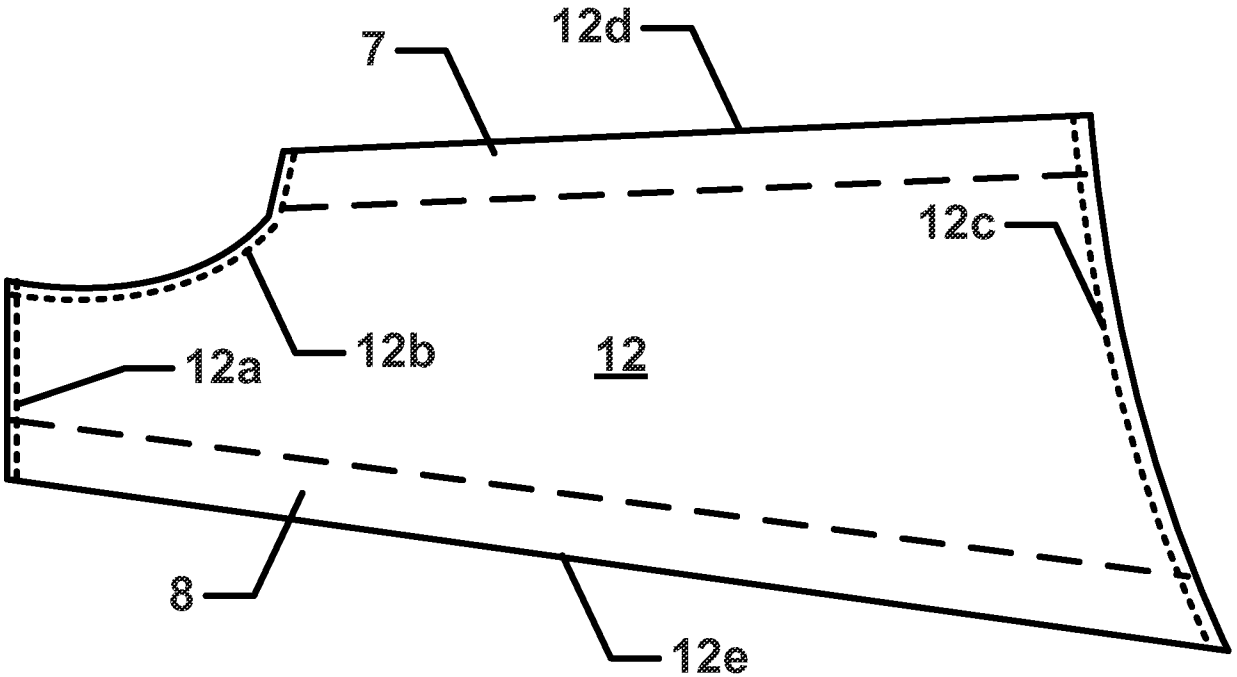
FIG. 3*c* is a schematic view of the side panel of FIG. 3*a*, wherein elastic bands that are inside the side panel are indicated.
Figure 3D:
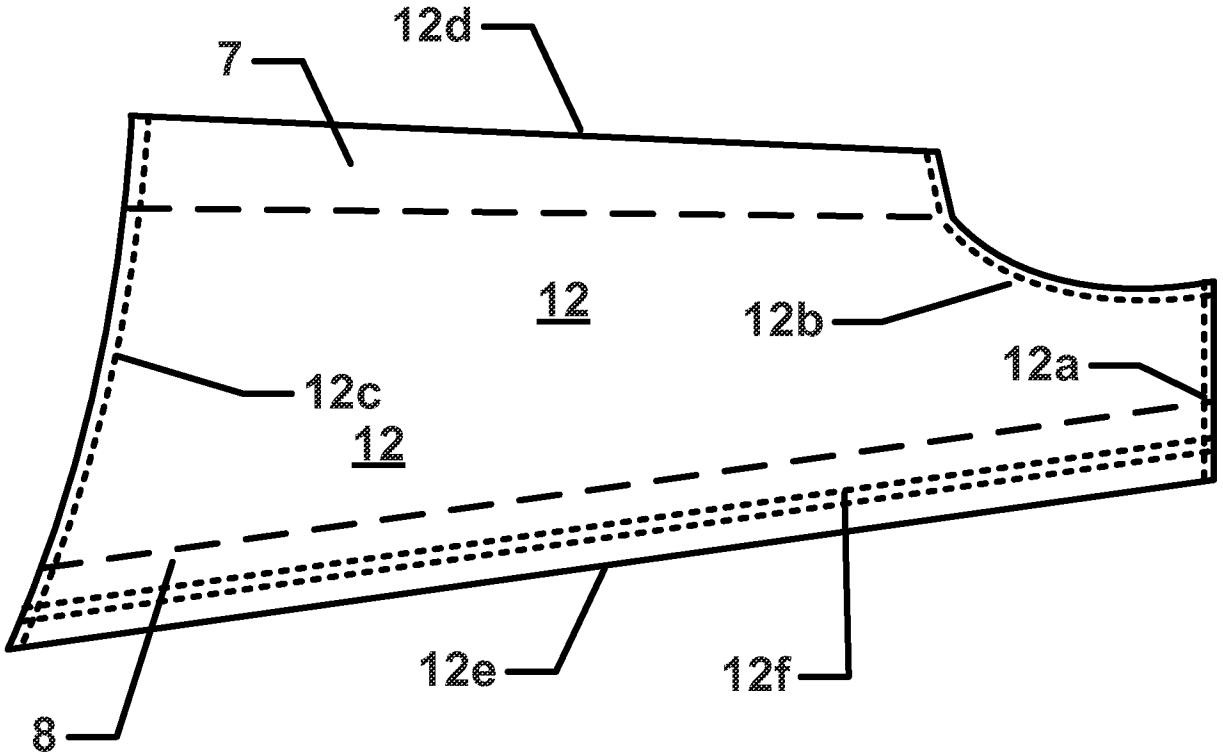
FIG. 3*d* is a schematic view of the side panel of FIG. 3*b*, wherein elastic bands that are inside the side panel are indicated.
Figure 3E:
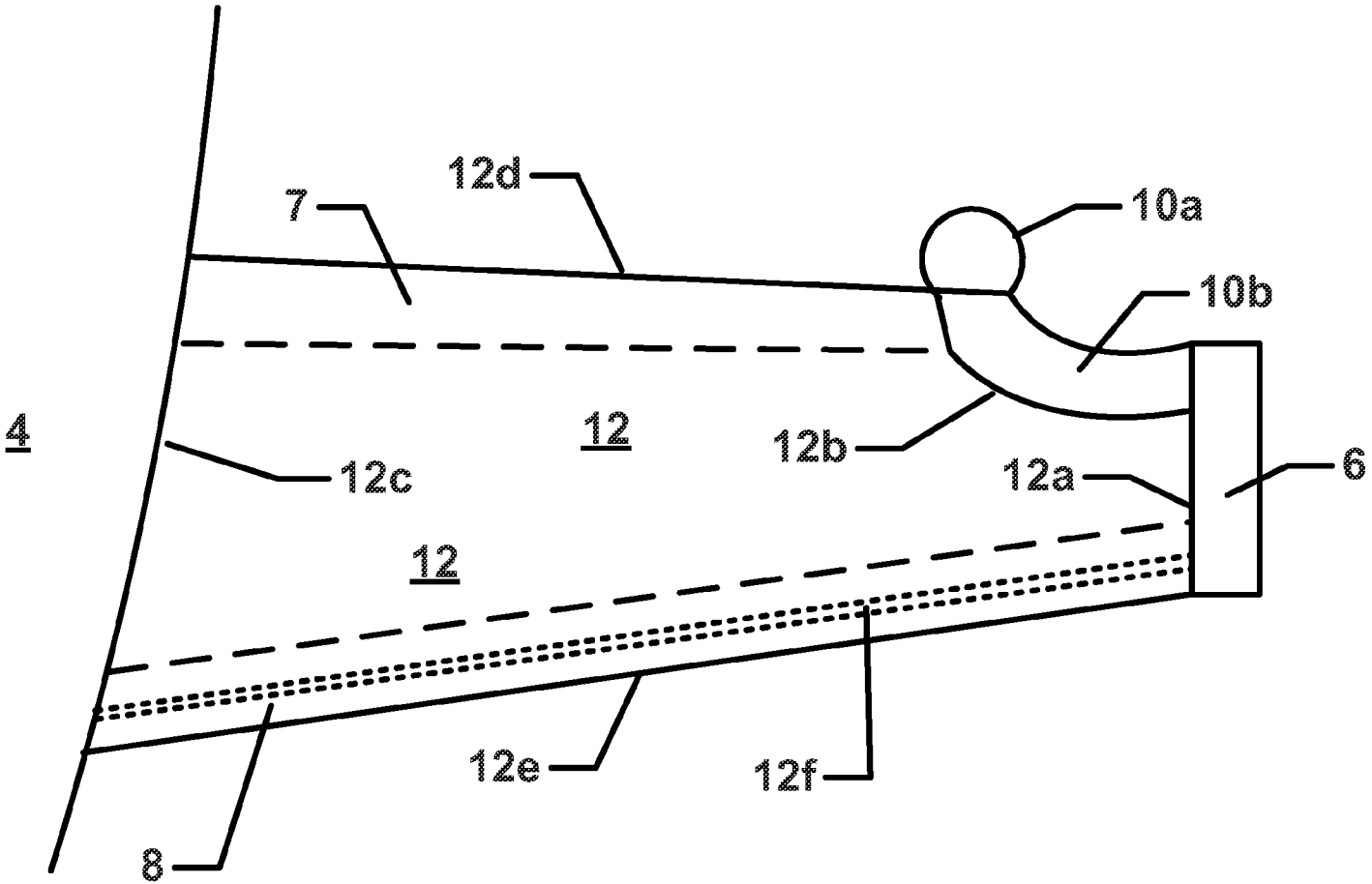
FIG. 3*e* is a schematic view of the side panel of FIG. 3*b* mounted in a portion of a bra, which is different from that shown in FIG. 1.
Figure 4:
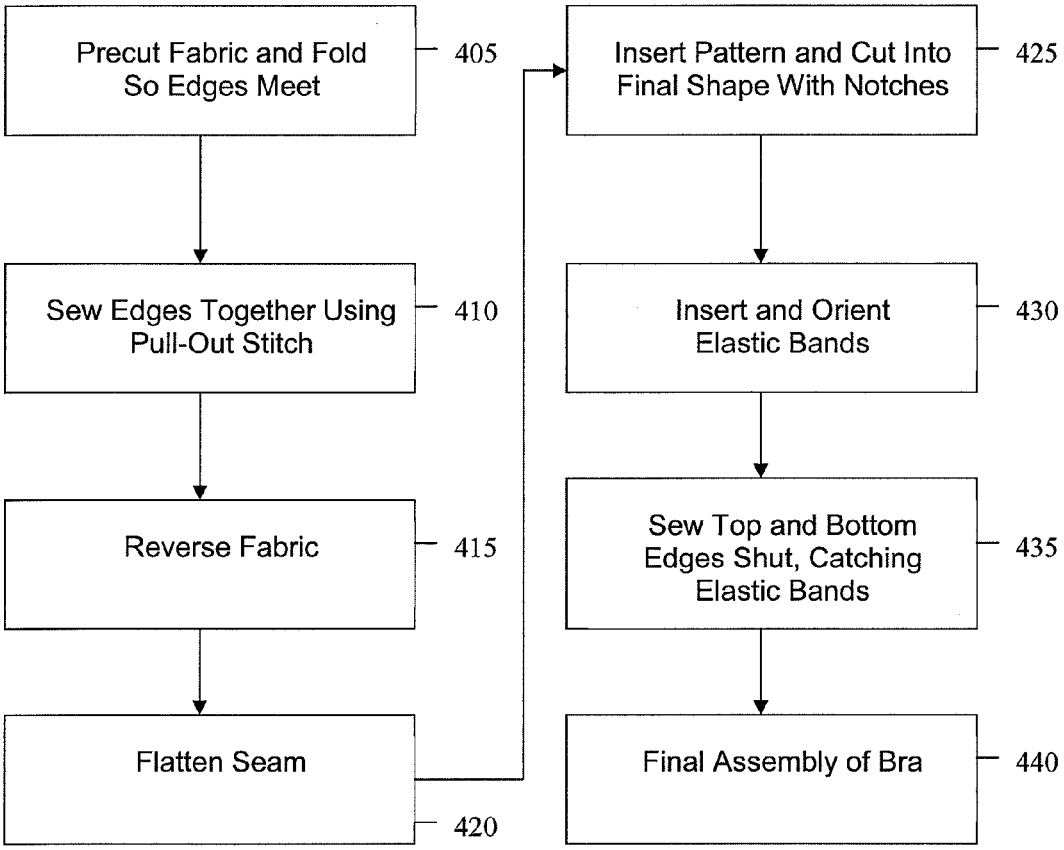
FIG. 4 illustrates a flow chart for a process of constructing a side panel of the brassiere according to a preferred embodiment of the invention.

Therein, as seen in FIG. 3*a*, the obverse of side panel 12 includes only edge stitching 12*a*, 12*b*, and 12*c* to which respectively abut a portion of the closure 6, a bra strap 7 or bras strap attachment means 10*a*, 10*b*, or bra cup 3. In contrast, peripheral edges 12*d* and 12*e* do not include stitching and are configured as folded over fabric. The shape of the edges 12*d* and 12*e* is maintained by the elastic bands 7 and 8, respectively, as can be seen in FIG. 3*c*. As seen in FIG. 3*b*, the reverse side includes a longitudinal stitching 12*f* as and edge stitch 12*a*-12*c*.

Figure 2:
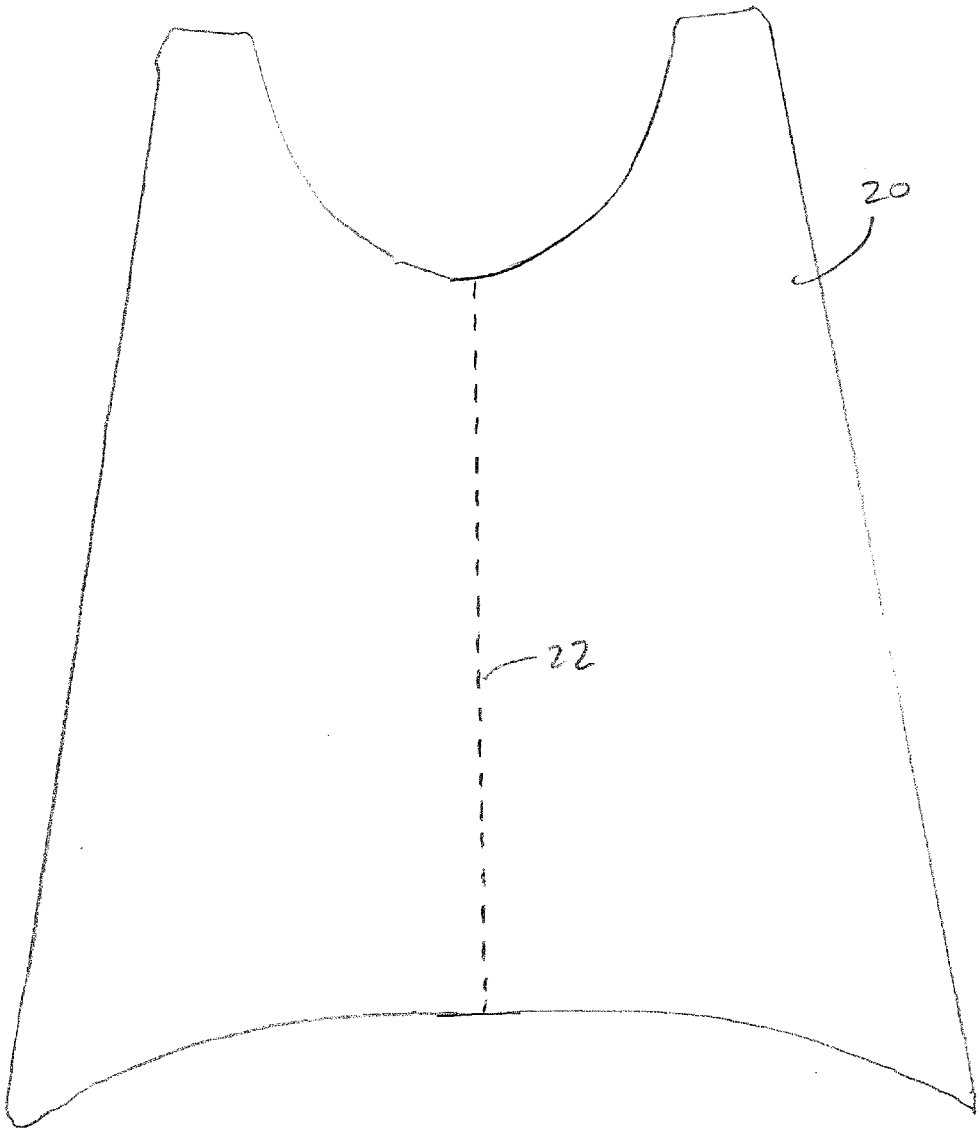
FIG. 2 illustrates a fabric to be used to form a side panel of a brassiere according to a preferred embodiment of the invention.

Side panel 12, e.g., side panel 13, is constructed by executing the following steps:

In the first step 405, using a single piece of fabric (not shown), the fabric is precut into a preferred shape and then folded so that the edges meet. Referring to FIG. 2, a fabric 20 is folded along dotted line 22 such that the left-side edge meets the right-side edge.

In the second step 410, the left-side edge and right-side edge are sewn with stitching 12*f*, preferably using a pull-out stitch, thereby forming a seam. In this manner, the fabric has a tubular structure with unsewn openings at the top and bottom edges.

In the third step 415, the fabric is reversed such that the interior of the tubular structure is turned to the exterior and the exterior of the tubular structure is turned to the interior.

In the fourth step 420, the seam is flattened to reduce irritation to the skin of the wearer.

Figure 5A:
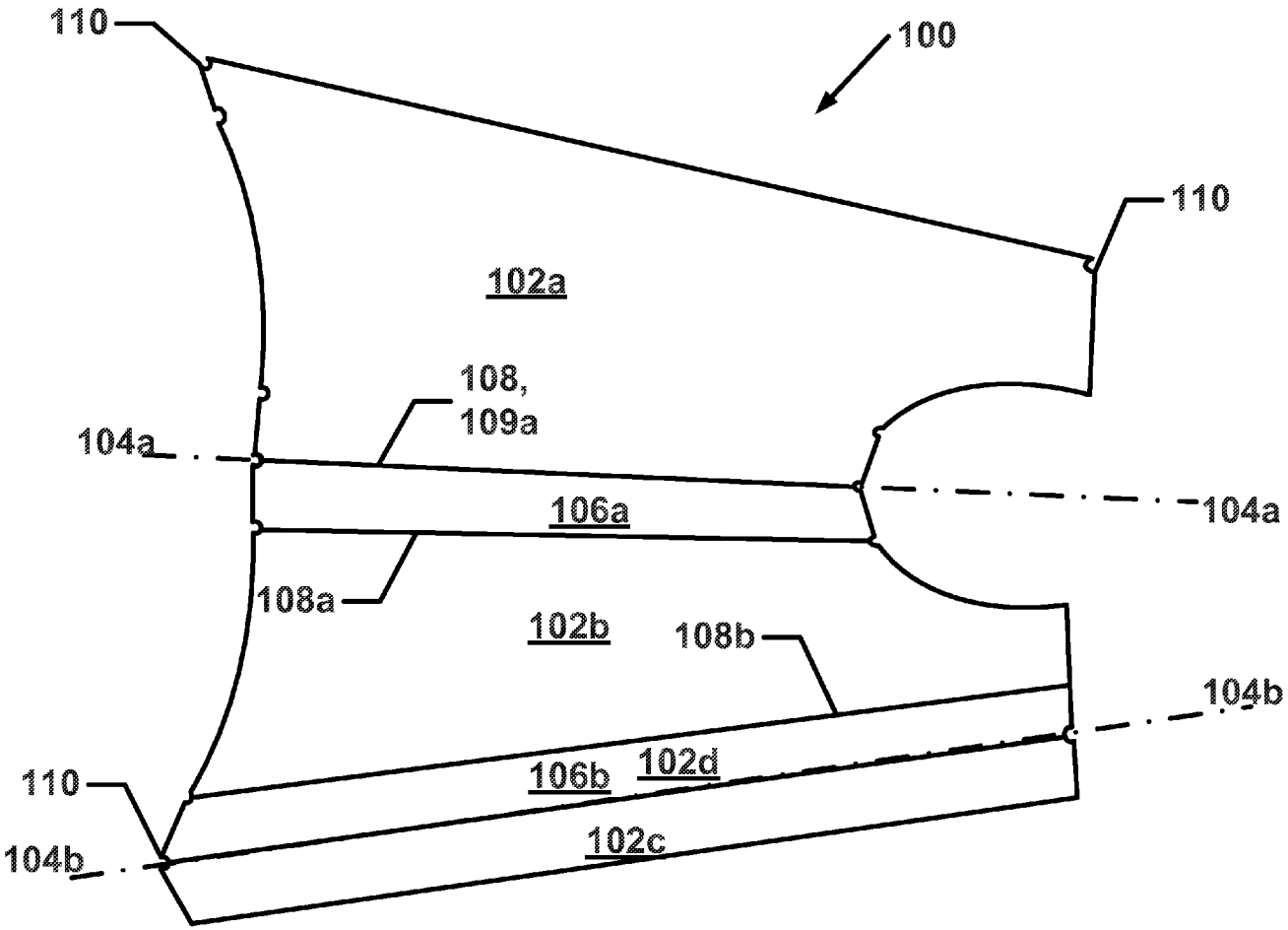
FIG. 5*a* illustrates a pattern fully flattened used in the process of constructing a side panel of the brassiere according to a preferred embodiment of the invention.
Figure 5B:
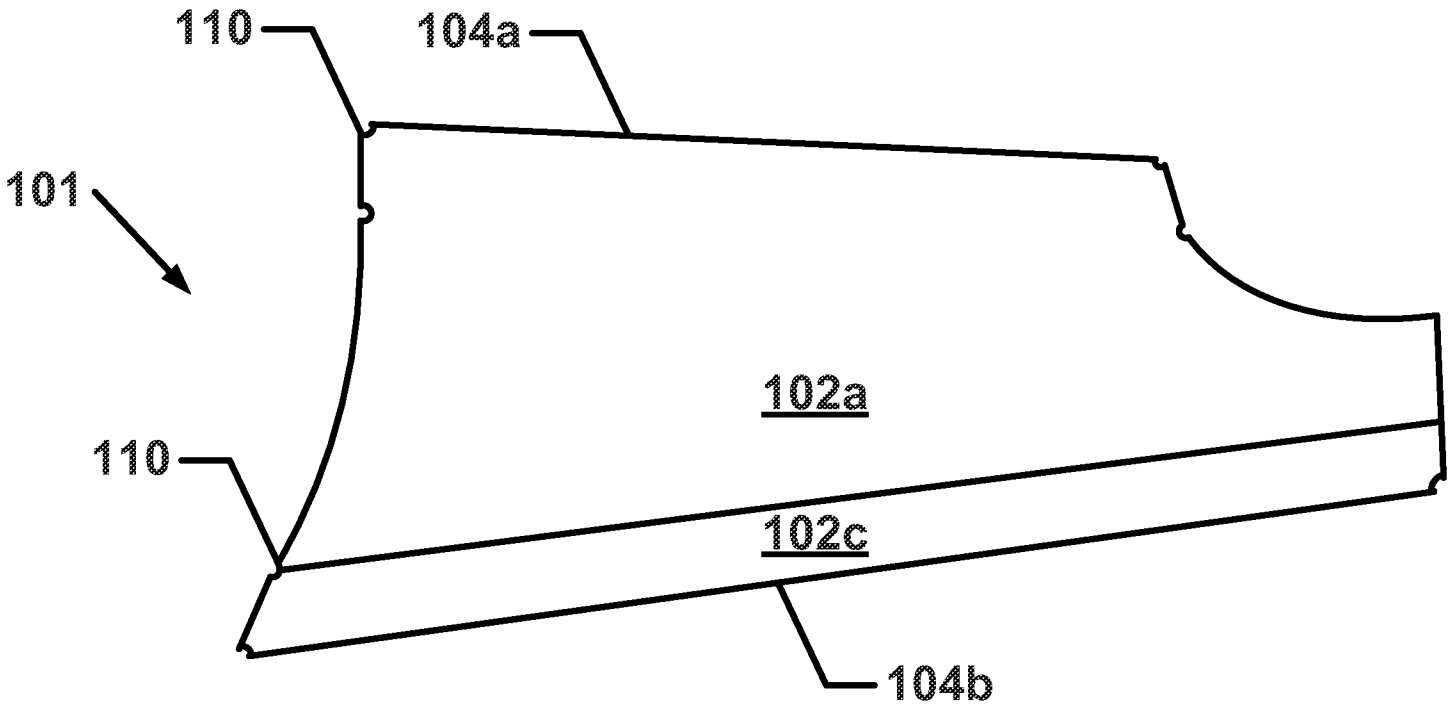
FIG. 5*b* illustrates the pattern of FIG. 5*a* in a folded state.

In the fifth step 425, a pattern 100 is used in folded position 101, which is illustrated in FIG. 5*b*, and then the fabric is cut along the pattern into the final shape of the side panel 12.

Pattern 100 includes periphery 101 that when folded comprises a shape of side panel 12, e.g., side panel 13. Panel 100 comprises a first area 102*a* and a second area 102*b* that are substantially symmetrical about an axis 104*a*. Pattern 100 includes a third area 102*c* and is substantially symmetrical about an axis 104*b* with a subarea 102*d*, which is a portion of area 102*b*.

Pattern 100 further includes area 106*a* defined between a fold line comprised along axis 104*a* and fold lines and/or embossed lines 108*a* and area 106*b* defined between a fold line comprised along axis 104*b* and folded and/or embossed line 108*b*. Therein, a plurality of notches 110 are present in the pattern.

Pattern 100 is then folded over along fold lines, e.g., axis. 104*a* and 104*b* to form a folded pattern shape 101 wherein area 102*a* is directly opposite area 102*b* and area 102*c* is opposite area 102*d*.

Therein in step 425, the fabric is cut such that edges of the fabric include notches that correspond to one or more notches 110 in the pattern.

In the sixth step 430, broad elastic bands 7, 8 are inserted into the fabric so that they are positioned along the two longitudinal edges of the side panel 12 and being positioned into the folded over pattern such that they are located in areas 106*a* and 106*b*, respectively. Notches 110 are used to orient the elastic bands and secure the elastic bands via stitching.

In alternative, the elastic bands are placed in areas 106*a* and 106*b* when the pattern is open. When the pattern is folded over, the elastic bands are retained via embossed or folded lines 108*a*, 108*b*.

The pattern in a folded state and including the elastic bands is then inserted into the tube structure of fabric.

In the seventh step 435, side edges of the fabric are sewn shut, preferably using a single needle stitch, and forming edge stitching 12*a*, 12*b*, and 12*c*. In sewing these edges shut via edge stitching 12*a*, 12*b*, 12*c*, the elastic bands 7, 8 are sewn together with the fabric, thereby holding the elastic bands in place.

Lastly, in step 440, in a final assembly, the side panel 12 is sewn together with the bra cups, and a back-connecting portion is sewn together on the distal end of the side panel 12.

The base fabric for the side panel 12 preferably includes a two-way stretch fabric that has excellent recovery properties, often referred to as bounce-back property. Preferably, a traditional stitched design is used, although a fused design is also possible. In this manner, a side panel 12 may be constructed to have flexibility, durability, and maximum comfort to the wearer. In addition, the procedure described above and in FIG. 4 is intended to minimize the number of seams. This is enabled by using a pull-out stitch, which is accomplished by folding the top back edge and then joining the bottom raw edges with an open merrow machine. In addition, the inside facing elastic is "free floating," which permits unrestricted movement of the fabric.

The elastic bands 7, 8 may be made from a knitted elastic or a woven elastic. Preferably, the width of each elastic band may be within the range of 8-25 millimeters, and more preferably, the width is selected from the following exemplary widths: 10 millimeters, 13 millimeters, 16 millimeters, 18 millimeters, 19 millimeters, 22 millimeters, and 25 millimeters.

Figure 6A:
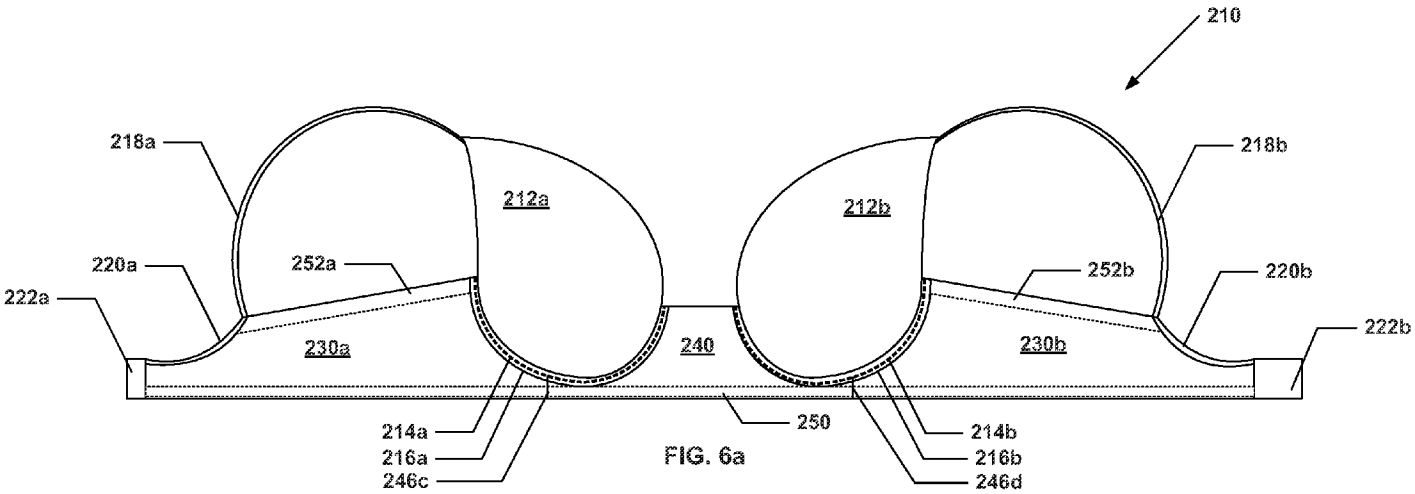
FIGS. 6*a* and 6*b* are a planar view of a front and a back, respectively, of a final-assembly brassiere in accordance with one or more further embodiments of the present invention.
Figure 6B:
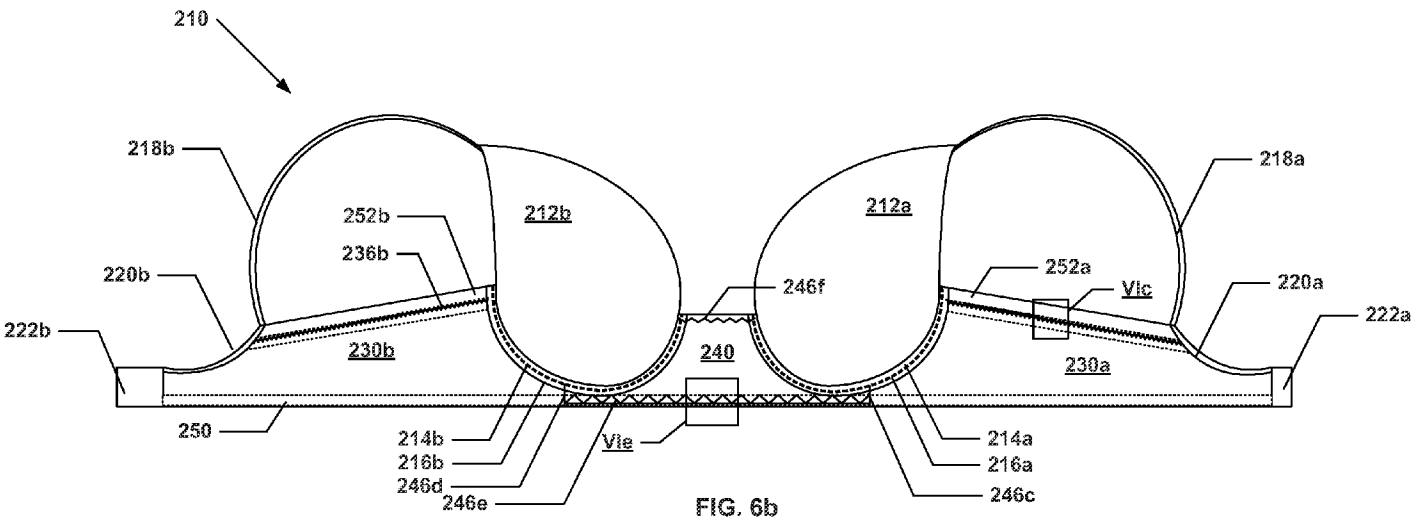
Figure 6C:
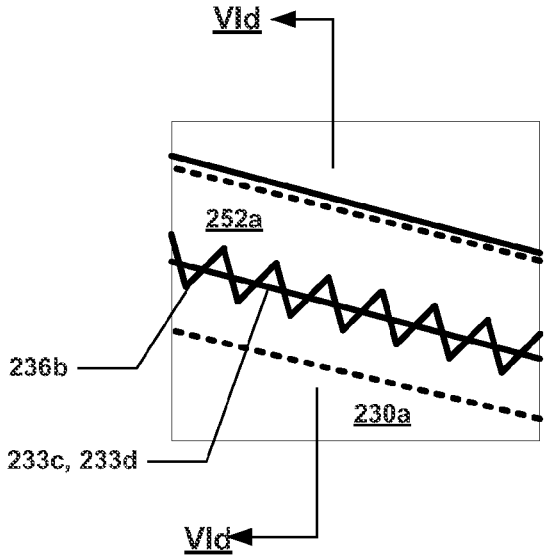
FIG. 6*c* is a detail view of a portion of the brassiere of FIGS. 6*a* and 6*b* taken from FIG. 6*b*.
Figure 6D:
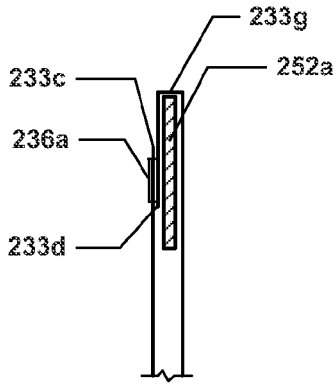
FIG. 6*d* is a cross-sectional view of the brassiere of FIGS. 6*a* and 6*b* taken from FIG. 6*c*.
Figure 6E:
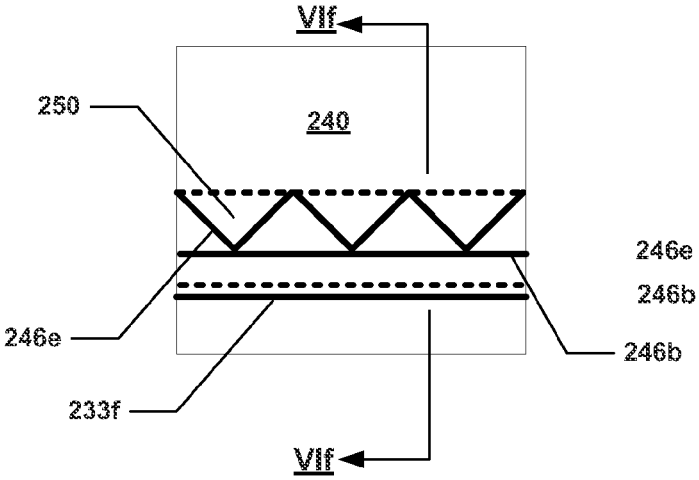
FIG. 6*e* is a detail view of a portion of the brassiere of FIGS. 6*a* and 6*b* taken from FIG. 6*b*.
Figure 6F:
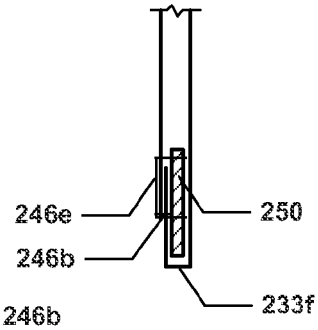
FIG. 6*f* is a cross-sectional view of the brassiere of FIGS. 6*a* and 6*b* taken from FIG. 6*e*.

FIGS. 6*a* and 6*b* are a planar view of a front and a back, respectively, of a brassiere in accordance with one or more further embodiments of the present invention. Therein, brassiere 210 provides improved comfort to a female wearer. As the user moves, for example, while reaching for an object, each of the user's breasts exerts a different pressure on a brassiere. Brassiere 210 flexes, e.g., stretches, independently with respect to each breast cup distributing the forces created by a user's movement for improved comfort and substantially continuous support of the breasts. Brassiere 210 may incorporate any feature taught above.

In accordance with one or more embodiments of the present invention, brassiere 210 comprises a pair of breast cups 212*a*, 212*b* preferably supported by underwires 214*a*, 214*b*, respectively, secured at least partially by underwire envelopment 216*a*, 216*b* in the respective breast cup and/or in a respective side panel. Breast cups 212*a*, 212*b* may be any suitable cups including molded, formed, and/or shaped and may be padded, but preferably are unpadded. Underwire envelopment 216*a*, 216*b* may be any suitable construction technique for securing the underwire and breast cups with the side panels.

A pair of straps 218*a*, 218*b* fit over the wearer's shoulders and connect at one end to strap attachment means 220*a*, 220*b*, respectively, and connect at another end to breast cups, 212*a*, 212*b*, respectively. Each strap 218*a*, 218*b* is adjustable in length by any suitable means, and includes one or more or hooks, snaps, hook-and-loop fasteners, and releasable adhesives. Each strap 218*a*, 218*b* may have an suitable width for the comfort of the wearer.

Brassiere 210 further includes a closure device comprises a first and second portion 222*a*, 222*b*, respectively, which are disposed at one end of side panels 230*a*, 230*b*, respectively. The other end of each of the side panel is secured in part to the respective breast cup and may envelope the respective underwire. The closure device may include any suitable device to secure brassiere 210 to the wearer and preferably includes a hook and eye fastener combination disposed on the respective portions 222*a*, 222*b*.

A front panel 240 is disposed between the breast cups and secured at least partially by underwire envelopment 216*c*, 216*d* in the respective breast cup and/or in a respective side panel.

An elastic band 250, which may be any suitable elastic band, is disposed proximal to a lower edge of the side panels 230*a*, 230*b* and front panel 240 so that band 250 substantially surrounds the torso of the wearer and helps improve comfort by distributing stresses. A pair of elastic side bands 252*a*, 252*b* is disposed proximal to an upper edge of respective side panel 230*a*, 230*b* and provides increased comfort and flex, e.g., stretch, during wear.

Preferably, the width of each elastic band may be within the range of 8-25 millimeters, and more preferably, the width is selected from the following exemplary widths: 10 millimeters, 13 millimeters, 16 millimeters, or 19 millimeters.

Figure 11:
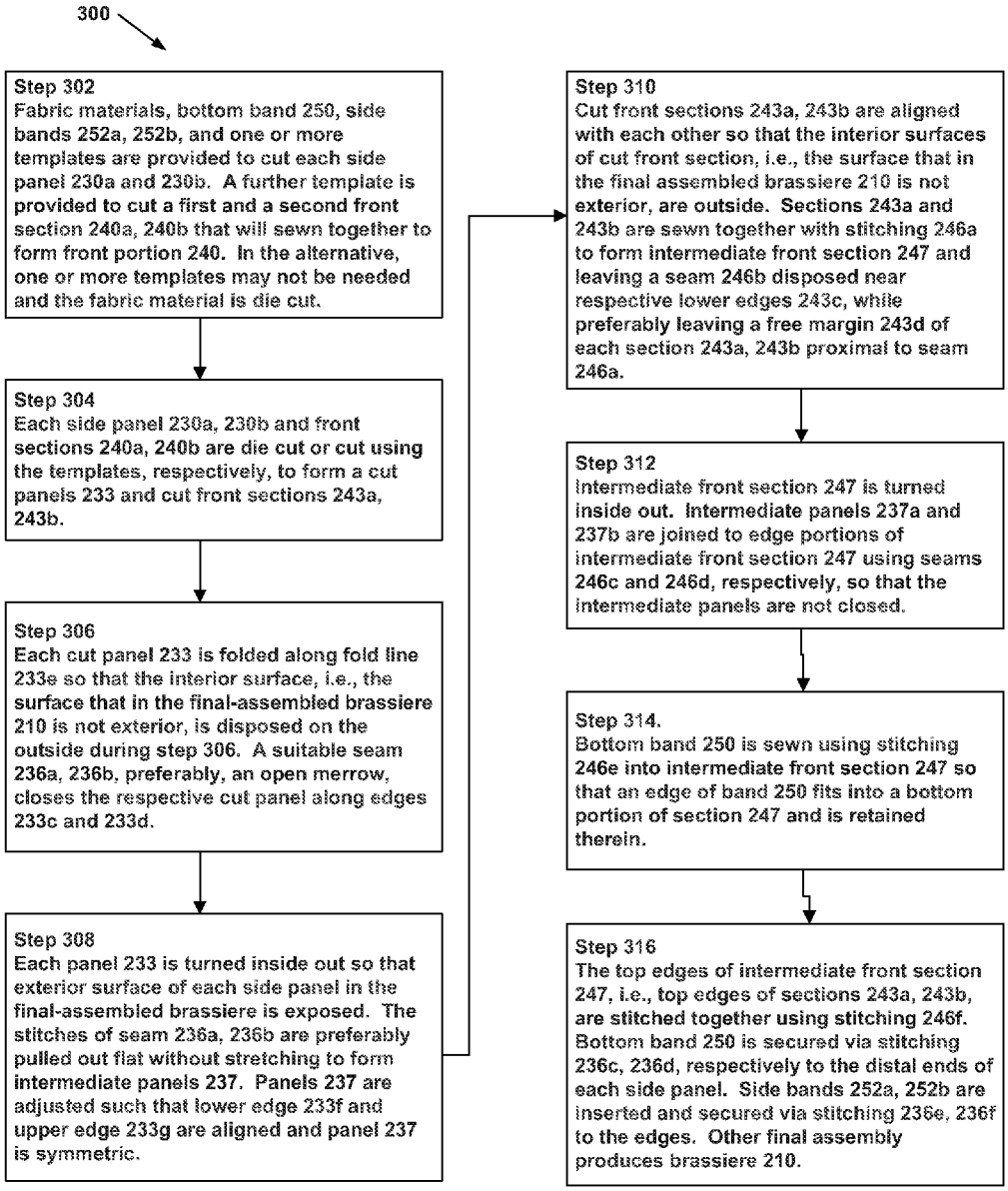
FIG. 11 illustrates a flow chart for a process of constructing of the brassiere of FIGS. 6*a* and 6*b*.

FIG. 11 illustrates a flow chart for a process of constructing of the brassiere of FIGS. 6*a* and 6*b*. Brassiere 210 is preferably made by the following method 300.

In a preliminary step 302, fabric materials, bottom band 250, side bands 252*a*, 252*b*, and one or more templates are provided to cut each side panel 230*a* and 230*b*. A further template is provided to cut a first and a second front section 240*a*, 240*b* that will sewn together to form front portion 240. In the alternative, one or more templates may not be needed and the fabric material is die cut.

In a subsequent step 304, each side panel 230*a*, 230*b* and front sections 240*a*, 240*b* are die cut or cut using the templates, respectively, to form a cut panels 233 and cut front sections 243*a*, 243*b*.

Figure 7A:
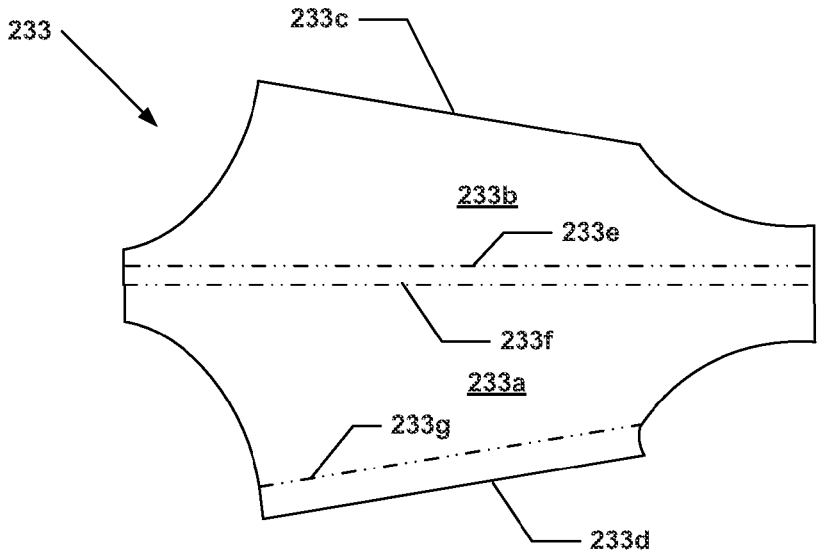
FIG. 7*a* is a planar view of a cut panel in accordance with one or more embodiments of the present invention during assembly of the brassiere of FIGS. 6*a* and 6*b*.
Figure 8A:
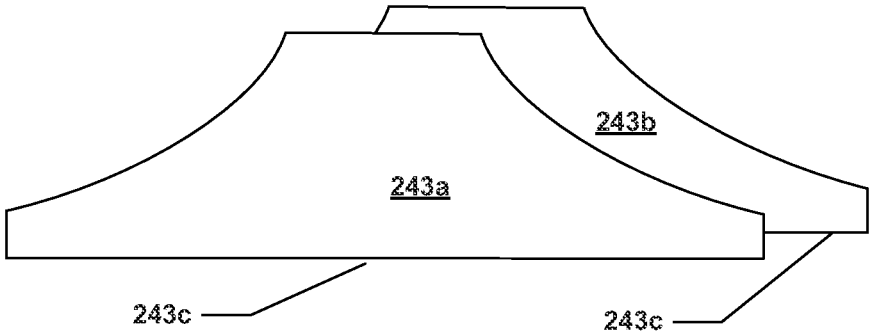
FIG. 8*a* is a planar view of two cut front sections in accordance with one or more embodiments of the present invention during assembly of the brassiere of FIGS. 6*a* and 6*b*.

FIG. 7*a* is a planar view of a cut panel 233 in accordance with one or more embodiments of the present invention. FIG. 8*a* is a planar view of cut front sections 243*a* and 243*b* in accordance with one or more embodiments of the present invention.

Since side panels 230*a* and 230*b* are mirror images of each other, each cut panel 233 has the same shape for each side panel. When the fabric has a different textures, finish, or the like, the template is reversed so that the appropriate texture, finish, or the like is oriented properly to be on the exterior surface of final-assembled brassiere 210.

Because seams 236*a*, 236*b* are disposed off center with respect to an edge of the respective side panel, cut panel 233 when laid flat is not symmetric with respect to a fold line 233*e*.

Figure 7B:
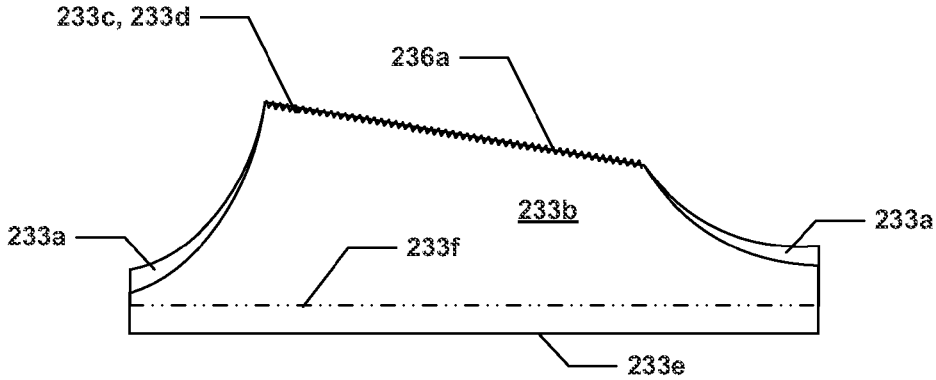
FIG. 7*b* is a planar view of a cut panel joined at an edge in accordance with one or more embodiments of the present invention during assembly of the brassiere of FIGS. 6*a* and 6*b*.

In step 306, each cut panel 233 is folded along fold line 233*e* so that the interior surface, i.e., the surface that in the final-assembled brassiere 210 is not exterior, is disposed on the outside during step 306. A suitable seam 236*a*, 236*b*, preferably, an open merrow, closes the respective cut panel along edges 233*c* and 233*d* as shown in FIG. 7*b*.

Figure 7C:
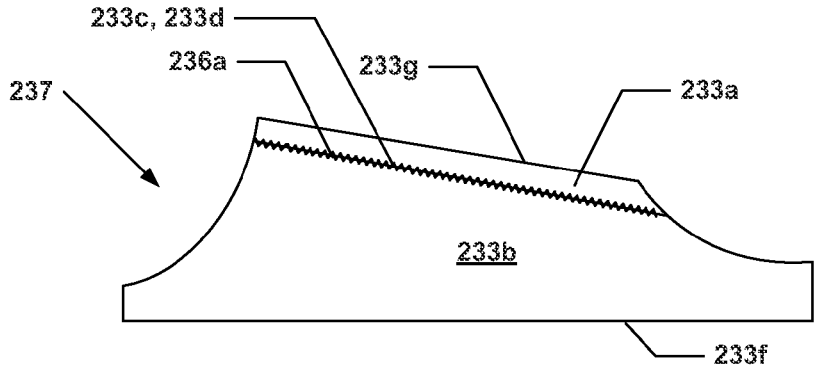
FIG. 7*c* is a planar view of an intermediate panel in accordance with one or more embodiments of the present invention during assembly of the brassiere of FIGS. 6*a* and 6*b*.

In step 308, each panel 233 is turned inside out so that exterior surface of each side panel in the final-assembled brassiere is exposed. The stitches of seam 236*a*, 236*b* are preferably pulled out flat without stretching to form intermediate panels 237. Panels 237 are adjusted such that lower edge 233*f* and upper edge 233*g* are aligned and panel 237 is symmetric as shown in FIG. 7*c*.

Figure 8B:
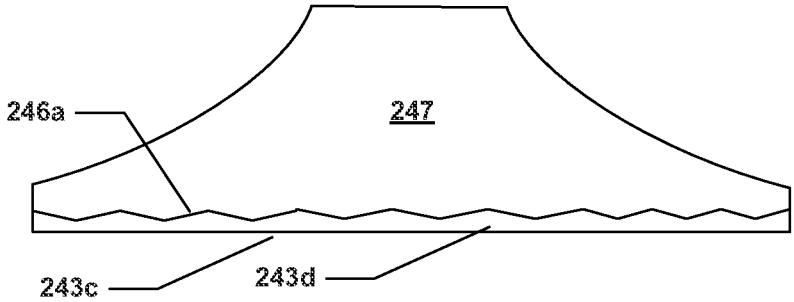
FIG. 8*b* is a planar view of an intermediate front section in accordance with one or more embodiments of the present invention during assembly of the brassiere of FIGS. 6*a* and 6*b*.

In step 310, cut front sections 243*a*, 243*b* are aligned with each other so that the interior surfaces of cut front section, i.e., the surface that in the final assembled brassiere 210 is not exterior, are outside. Sections 243*a* and 243*b* are sewn together with stitching 246*a* to form intermediate front section 247 and leaving a seam 246*b* disposed near respective lower edges 243*c*, while preferably leaving a free margin 243*d* of each section 243*a*, 243*b* proximal to seam 246*a* as shown in FIG. 8*b*.

In step 312, intermediate front section 247 is turned inside out. Intermediate panels 237*a* and 237*b* are joined to edge portions of intermediate front section 247 using seams 246*c* and 246*d*, respectively, so that the intermediate panels are not closed.

In step 314, bottom band 250 is sewn using stitching 246*e* into intermediate front section 247 so that an edge of band 250 fits into a bottom portion of section 247 and is retained therein as shown in FIGS. 5*e*, 5*f*, and 8*a*. Any suitable stitch may be used, but preferably a 3-step zig-zag stitch is used. Bottom band 250 is pulled through side panels 230*a*, 230*b* and left unsecured therein, i.e., float therein and elastic bands 252*a* and 252*b* are inserted to form an intermediate assembly brassiere 217.

Figure 9A:
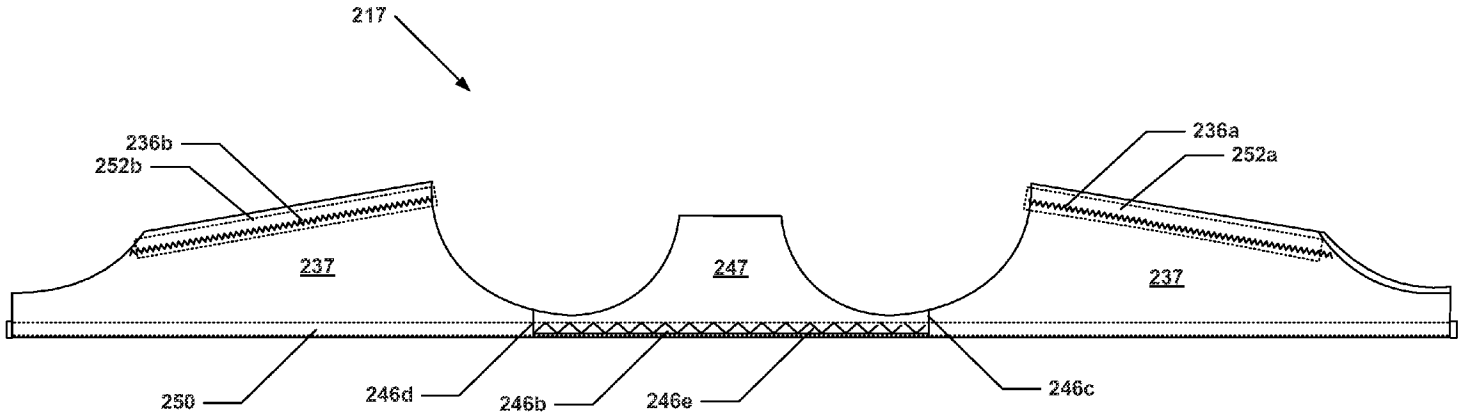
FIG. 9*a* is a planar view of an intermediate assembly brassiere in accordance with one embodiment of the present invention during assembly of the brassiere of FIGS. 6*a* and 6*b*.
Figure 9B:
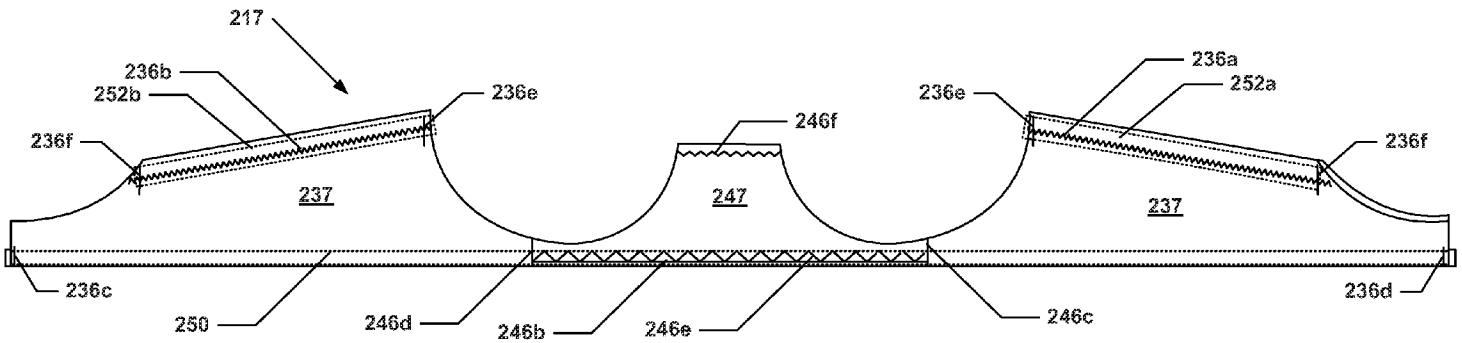
FIG. 9*b* is a planar view of an intermediate assembly brassiere in accordance with one embodiment of the present invention during subsequent assembly of the brassiere of FIG. 9*a*.

In step 316, the top edges of intermediate front section 247, i.e., top edges of sections 243*a*, 243*b*, are stitched together using stitching 246*f*. Bottom band 250 is secured via stitching 236*c*, 236*d*, respectively to the distal ends of each side panel. Side bands 252*a*, 252*b* are inserted and secured via stitching 236*e*, 236*f* to the edges as shown in FIG. 9*b*. The remaining edges of the side panels and front panel are stitched, using preferably zig-zag basting (not shown). Other final assembly produces brassiere 210.

Figure 10A:
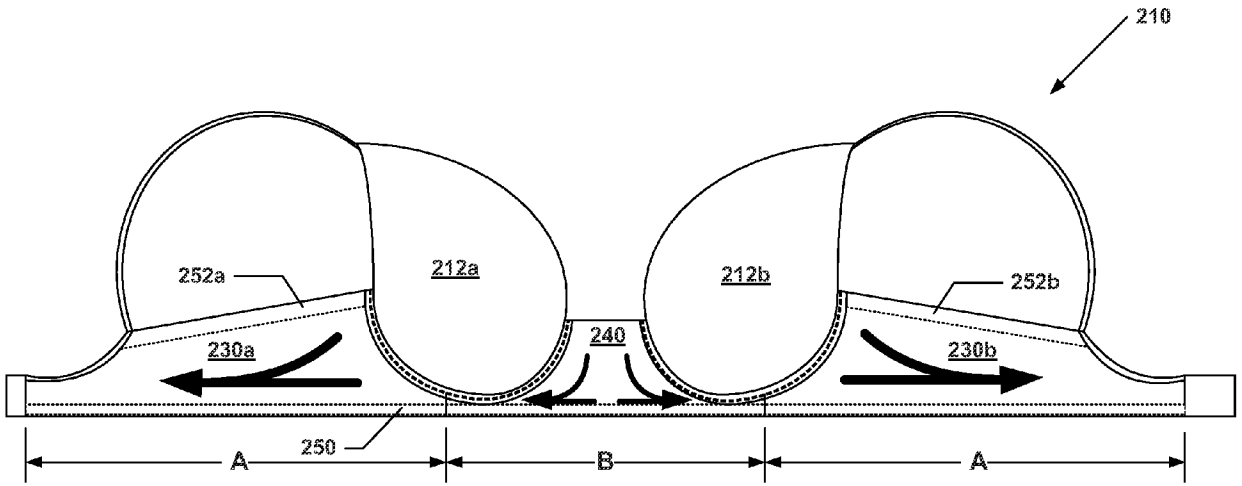
FIG. 10*a* is a planar front view of the brassiere of FIGS. 6*a* and 6*b* showing the relative flexibility, e.g., stretch, of the brassiere in accordance with one or more embodiments of the present invention.

FIG. 10*a* is a planar front view of the brassiere of FIGS. 6*a* and 6*b* showing the relative flexibility, e.g., stretch, of the brassiere in accordance with one or more embodiments of the present invention. Therein, since band 250 is secured to front portion via stitching 246, section B does not stretch as much as sections A, which coincide with side panels 230*a*, 230*b*, where band 250 is unsecured between stitching 246*d* and 236*c* and 246*c* and 236*d*, respectively. Thus, brassiere 210 in sections A stays close to the torso of wearer W since the fabric of the side panels can move relative to band 250 and minimizes gapping between the torso of the wearer and band 250.

Section A also has inherent stretch because bands 252*a*, 252*b* are unsecured between stitching 236*e* and 236*f*. Thus, brassiere 210 in sections A stays close to the body of wearer W since the fabric of the side panels can move relative to band 252*a*, 252*b* and minimizes gapping between the torso of the wearer and band 252*a*, 252*b*.

Figure 10C:
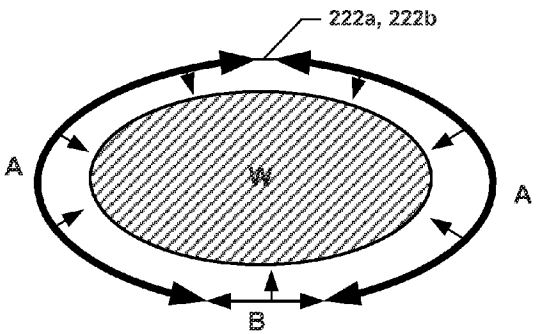
FIG. 10*c* is a cross-section schematic diagram of the stretch, e.g., flex, of brassiere of FIGS. 6*a* and 6*b* in the situation of FIG. 10*b*.
Figure 10B:
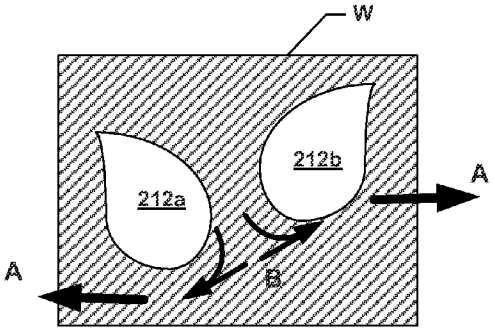
FIG. 10*b* is an elevational schematic diagram of the stretch, e.g., flex, of brassiere of FIGS. 6*a* and 6*b*.

FIG. 10*b* is an elevational schematic diagram of the stretch, e.g., flex, of brassiere of FIGS. 6*a* and 6*b*. FIG. 10*c* is a cross-section schematic diagram of the stretch, e.g., flex, of brassiere of FIGS. 6*a* and 6*b* in the situation of FIG. 10*b*. Therein, a wearer W experiences the dislocation of breast cups 212*a*, 212*b* relative to each other during movement. Due to the stretch in front portion 240, e.g., band 250 in section B, the front portion pushes inward on the torso but also transfer stretch to sections A. In sections A, band 250 and bands 252*a*, 252*b*, respectively, push inward on the torso but also if necessary distribute the force via the closure to each other to even the circumferential force and improve comfort. However, preferably, each side panel is independently flexible.

The skilled person will appreciate and recognize that the above and related objects, features, and advantages of the present invention are illustrative merely, and not limiting. The stitching and seams herein are exemplary; while they are believed to offer significant advantages over other types of stitching, other stitching or other means of securing fabric to each other may be used.

While the foregoing detailed description has described particular preferred embodiments of this invention, it is to be understood that the above description is illustrative only and not limiting of the disclosed invention. While preferred embodiments of the present invention have been shown and described herein, it will be obvious to those skilled in the art that such embodiments are provided by way of example only. Numerous variations, changes, and substitutions will now occur to those skilled in the art without departing from the invention.

What is claimed is:

1. A comfortable brassiere having side panels that flex independently to conform to a wearer's movements, the brassiere comprising:

a front including a pair of cups, each cup being configured and dimensioned to hold substantially one breast of a wearer, having wire supports sewn into the lower portion of each cup; and a front-connecting portion, connecting the cups to each other at said front;

a pair of side panels, each side panel having two end edges, a top edge that is attached to a cup and the lower portion of the front-connecting portion, and a bottom edge that is attached to one part of a two-part fastening mechanism for securing the brassiere at the back of the wearer;

wherein a free-floating stretch-elastic band runs continuously from one bottom edge of one side panel to the bottom edge of the other side panel, along a bottom longitudinal edge of each side panel, and is sewn into the lower edge of the front-connecting portion, a pair of fixed stretch-elastic bands are sewn into top longitudinal edges of the pair of side panels, and a third stretch-elastic band is sewn into the upper edge of the front-connecting portion; and wherein shoulder straps have one end that is secured to the respective cup are secured to the cups and an opposite end secured to the respective side panel.

2. The brassiere of claim 1, wherein the side panels and the front-connecting portion are formed from a single piece of material.

3. The brassiere of claim 1, wherein the stitching along the top longitudinal edge of the side panels is single-needle stitching.

4. The brassiere of claim 1, wherein the stitching along the bottom longitudinal edge of the side panels is single-needle stitching.

5. The brassiere of claim 1, wherein at least one of the free-floating stretch-elastic band, fixed stretch-elastic bands and the third elastic band is woven.

6. The brassiere of claim 1, wherein at least one of the free-floating stretch-elastic band, fixed stretch-elastic bands and the third elastic band is knitted.

7. A method of making a brassiere that provides side panels that flex independently of each other, providing comfort to the wearer, the method comprising the steps of:

cutting from a material two side-panel configured pieces, each side-panel configured piece comprising a first longitudinal edge and a second longitudinal edge, folding each of the side-panel configured pieces face to face to form a folded edge as a bottom longitudinal edge of each side panel, joining the first longitudinal edge and the second longitudinal edge of each of the side-panel configured pieces with an open merrow to form a top longitudinal edge of each side panel;

for each side-panel configured piece, turning inside out each side-panel configured piece, completing stitching along each top longitudinal edge, and pulling each stitch without stretching to form;

cutting from the material a front-connecting configured piece of material, forming a front-connecting portion by folding the front-connecting configured piece of material to form an upper edge and a lower edge, the upper edge being sewn to close the front-connecting configured piece of material;

positioning a free-floating stretch-elastic band along the bottom longitudinal edge of each of the side panels and the lower edge of the front-connecting portion, sewing the stretch-elastic band into the lower edge of the front-connecting portion, and sewing the ends of the elastic band into ends of the bottom longitudinal edges at the bottom edge of each side panel;

joining by sewing the top ends of the front-connecting portion to form the upper edge;

sewing each of a pair of fixed stretch-elastic bands along the top longitudinal edge of its respective side panel;

sewing a third elastic band into the upper edge of the front-connecting portion;

sewing a pair of cups having wire supports into place on either side of the front-connecting piece and the top edge of each side panel;

sewing a first portion of a fastener to the bottom edge of each side panel; and thereafter securing cups, shoulder straps and a second portion of the fastener thereto.

8. The method of claim 7, wherein the side panels and the front-connecting portion are formed from a single piece of material.

9. The method of claim 7, wherein the stitching along the top longitudinal edge of the side panels is single-needle stitched.

10. The method of claim 7, wherein the stitching along the bottom longitudinal edge of the side panels is single-needle stitched.

11. The method of claim 7, wherein at least one of the free-floating stretch-elastic band, fixed stretch-elastic bands and the third elastic band used is woven.

12. The method of claim 7, wherein at least one of the free-floating stretch-elastic band, fixed stretch-elastic bands and the third elastic band used is knitted.

* * * * *